United States Patent [19]

Takagi et al.

[11] 4,065,928

[45] Jan. 3, 1978

[54] METHOD FOR CONSTRUCTING A RELIABLE FOUNDATION IN SOFT SOIL FORMATIONS

[75] Inventors: Atsushi Takagi, Yokohamashi; Hiroyuki Kuroiwa, Chofushi; Masao Miyaguchi, Tokyo; Tateo Kawamura, Tokyo, all of Japan

[73] Assignee: Takenaka Komuten Company, Ltd., Osaka, Japan

[21] Appl. No.: 719,698

[22] Filed: Sept. 2, 1976

[30] Foreign Application Priority Data

Sept. 11, 1975 Japan ..... 50-110570

[51] Int. Cl.[2] ..... E02D 3/12

[52] U.S. Cl. ..... 61/36 R; 61/53.6

[58] Field of Search ..... 61/36 R, 35, 53.6, 53.64, 61/63, 53.66

[56] References Cited

U.S. PATENT DOCUMENTS

| | | | |
|---|---|---|---|
| 2,680,416 | 6/1954 | Russell | 61/36 R |
| 2,718,761 | 9/1955 | Steverman | 61/36 R |
| 2,782,605 | 2/1957 | Wertz et al. | 61/36 R |
| 3,023,585 | 3/1962 | Liver | 61/36 R |
| 3,243,962 | 4/1966 | Ratliff | 61/36 R |
| 3,875,751 | 4/1975 | Paus | 61/36 R |

*Primary Examiner*—Dennis L. Taylor

[57] ABSTRACT

A method for constructing a tubular pile foundation in soft soil formations comprises agitating the soft soil to form an agitated region like a tube with single annular section or tubes with conjugated annular section at a time, injecting chemical hardener and mixing it with the soft soil to solidify the agitated region in situ into a tubular pile or conjugated tubular piles. By repeating the foregoing steps, the structural wall of piles is constructed to provide bearing capacity with the soft soil formations.

6 Claims, 8 Drawing Figures

(A)

(B)

(A)

(B)

METHOD FOR CONSTRUCTING A RELIABLE FOUNDATION IN SOFT SOIL FORMATIONS

BACK GROUND OF THE INVENTION

The present invention relates to a method for building up an improved foundation in soft and fine-grained soil, sand and the like.

When embankment fills or other structures are constructed on soft and loose soil deposited in the subsurface, it must be noted that linear compressive strength of soft soil under the bottom of the sea, for instance, is likely to be less than 1 kg/m$^2$. From this point of view, it is generally well known to stabilize the soft soil to increase the bearing capacity thereof so as to safely support the structures or the fills to be constructed.

Many of the methods described as follows have been heretofore employed for the purpose of stabilizing the soft soil formation.

1. Method for replacing soft soil with sand
2. Mat system for supporting the structure with continuous mat
3. Sand-drain system for accelerated consolidation
4. Lime pile drain system for accelerated consolidation
5. Method for solidifying soft soil by utilizing chemical agent However, the first, third and forth methods need the replacement of the soft or loose soils with sand or lime so that these methods must be spend painstaking labor and a lot of time especially when the site has a deep soft soil formation in relatively large area. In particular, the first method has met a problem to seek out a huge damp space which is able to receive a great amount of soil or sand removed from the site. The third method as well as the first method are, as a rule, unable to avoid settlement or sinking of the structures or embankment fills constructed.

The fifth method with which this invention is concerned was originally performed by solidifying the whole body of soft soil formation. It accordingly cost much labor, time and money. This original method was improved recently. The improved method comprising steps of vertically agitating the linearly restricted region of soft soil formation by utilizing the single shaft agitator, mixing chemical hardener with soft soils to construct a column pile structure in the soft soil formation and surrounding the untreated soft soils with a plurality of the said column pile structures. This prior method resulted in increase of the bearing capacity of the soft soil formations without treating whole quantity of the soils but with less chemical hardener and less period of performance.

This method heretofore employed however has included some problems to be solved. The thickness of the column pile structures has been substantially equalized to the spread of agitating blades attached to the shaft of the device. Then it is unable to decrease the thickness of the wall upon considering the efficiency of performance and also to excessively increase it because of incapability of uniform agitation. Consequently, the wall has been 1000 - 1500 mm in thickness. Further, it has been required skilled work to obtain certain joints in successive structures owing to the limitation of the wall's thickness. Futhermore, for surrounding the untreated soft soils with a plural column pile structures, numerous agitating shafts or many times of performance of agitator are required.

SUMMARY OF THE INVENTION

The general object of the present invention is to provide improved and simplified method for building up reliable foundation and strengthening soft and loose soil formations to the substantial depth without removing any of the original soil.

Another object of the invention is to provide methods for the purpose mentioned which are faster in operation and more economical in performance.

Still another object of the invention is to provide methods for the purpose mentioned which are able to easily obtain various size of foundation in thickness.

Further object of the invention is to provide methods for the purpose mentioned which are able to easily obtain certain joints in successive structures.

Still further object of the invention is to provide methods for the purpose mentioned which form stable foundations by fully utilizing the statical and dynamical performance of the improved cross-section.

Yet object of the invention is to provide methods for the purpose mentioned which are able to enclose a subsurface mass of soft soil whthin tubular structure with annulus in section at a single operation.

A characteristic feature of the invention by which the foregoing objects are accomplished is in the steps of vertically solidifying soft soil and sand into tubular pile with annulus or connected annulus wall in section to substantial depths and repeating the same operations at sufficiently close positions to the piles solidifyed in advance to form a continuous wall.

DETAILED DESCRIPTION OF THE INVENTION

Figure 1:
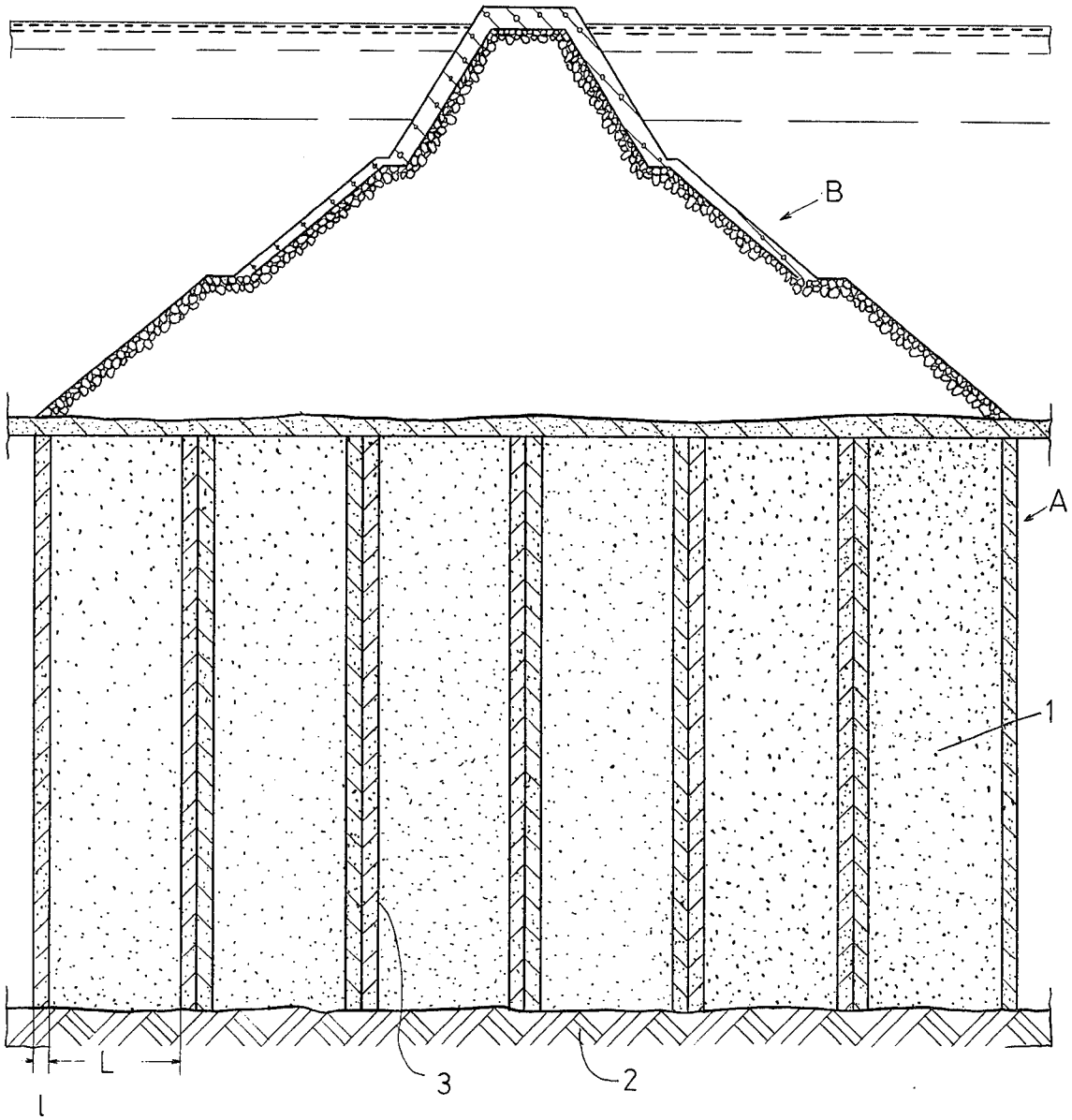
FIG. 1 is a longitudinal cross-section of a foundation built up according to the present invention and a structure constructed thereupon.
Figure 2:
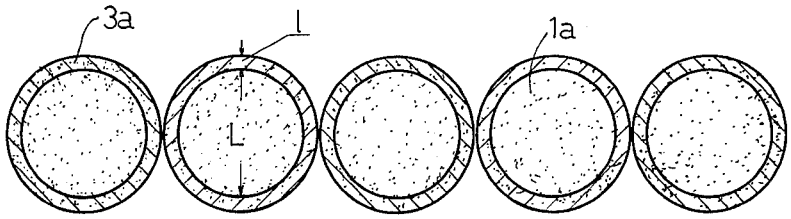
FIG. 2A is a cross-sectional view of successive tubular piles according to the invention being in contact with each other.
FIG. 2B is a similar view to FIG. 2A showing succession of the piles overlapping each other.
Figure 2:
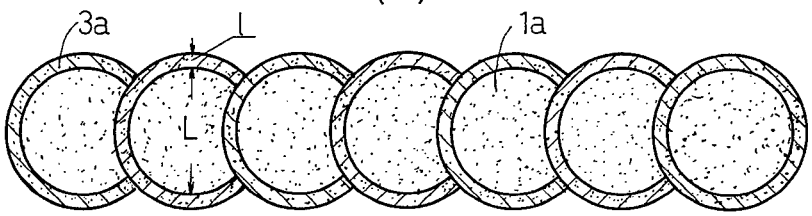
Figure 3:
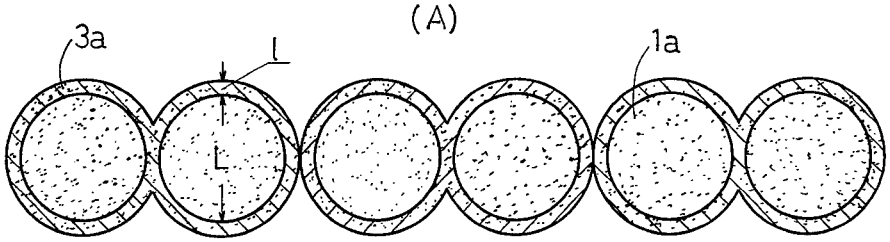
FIG. 3A is a similar view to FIG. 2A showing a modification of invention employing connected-tubular piles.
FIG. 3B is a similar view to FIG. 2B showing succession of the connected tubular piles overlapping each other.
Figure 3:
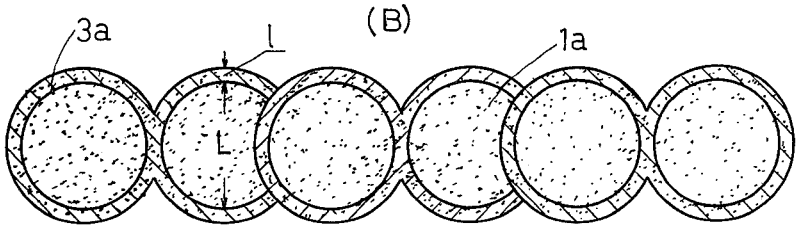

Referring to FIG. 1, a foundation A is built up in soft or loose soil 1 deposited on a hard soil substratum 2 of, for instance, the sea bottom. The foundation A consists of a plurality of tubu-like mass or piles 3 with annulus in section to form a cylindrical wall 3*a* solidified in place to the depth of the substratum 2. The piles 3 are formed in closely spaced positions horizontally extending over a selected area as shown in FIGS. 2A and 3A, or formed into a continuous wall by successive tubular piles sufficiently close together, actually with overlap as shown in FIGS. 2B and 3B.

Figure 4:
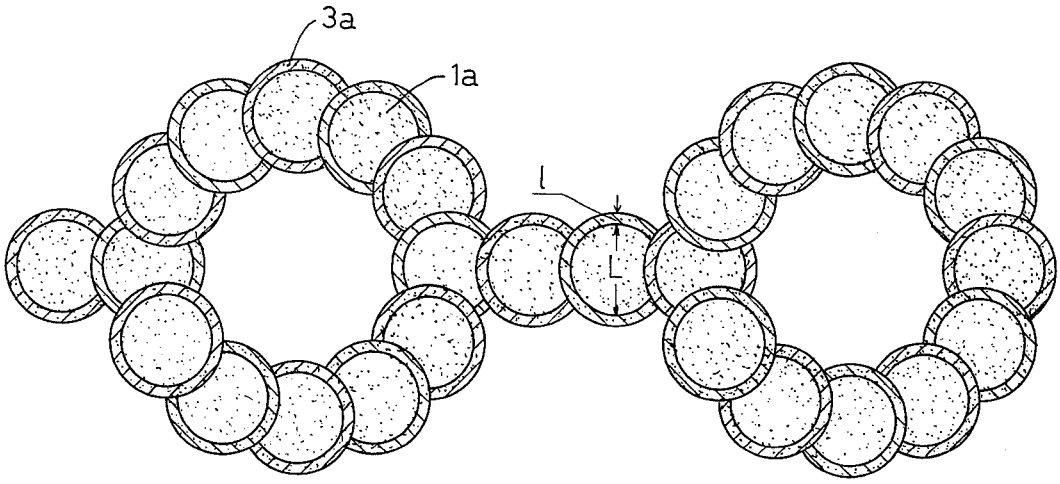
FIG. 4 is a cross-sectional view showing an example of further development of successive piles shown in FIG. 2B.

The thickness 1 and the diameter L of the tubular piles 3 should be determined before solidifying operation taking into account a number of the piles or the range of overlaps and the natures or properties of the soil so that a sufficient bearing capacity of the foundation is provided for supporting structures B, for instance, embankment fills. As clearly shown in FIGS. 2A to 4, the soft soil is surrounded at a restricted region 1*a* with the cylindrical wall 3*a* of individual tubular pile 3 (FIGS. 2A – 3B). And moreover the soft soil may be enclosed with a plurality of piles 3 successively disposed or circularized (FIG. 4).

The solidifying operations of the invention are accomplished, for instance, by employing an agitating device C which will be described in detail hereinafter.

Figure 5:
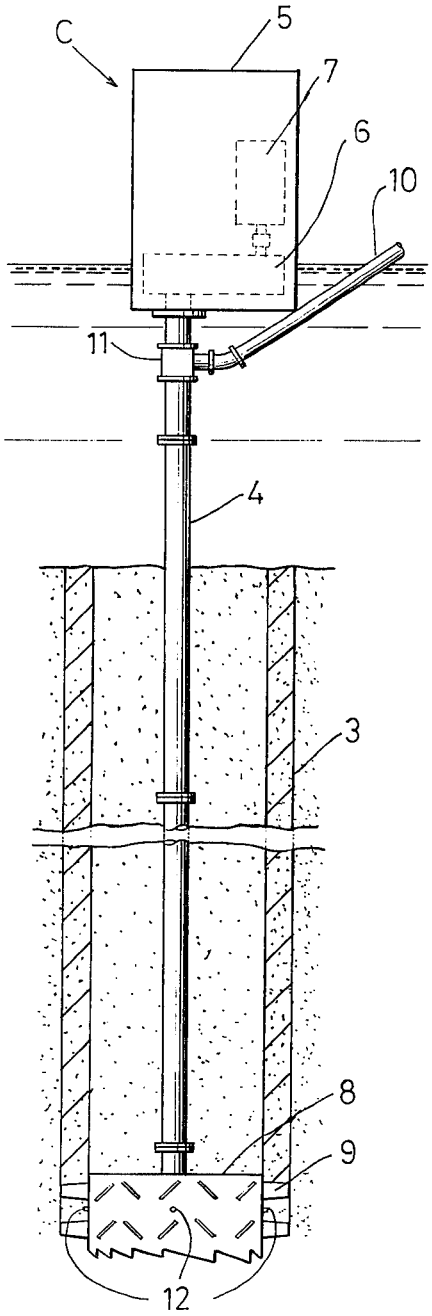
FIG. 5 and 6 are side elevational views of preferred forms of apparatuses employed for carrying out the invention, showing the apparatuses working in the soil with single shaft and double shafts, respectively.
Figure 6:
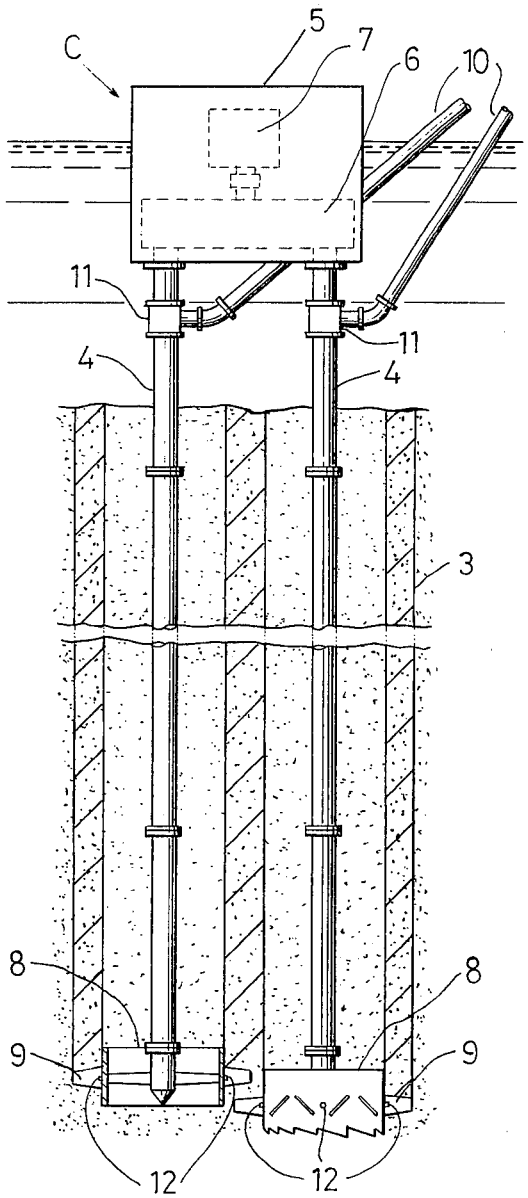

Turning now to FIG. 5, a shaft 4 is suspended from and operably connected to a machine box 5 which has therein a gear reducer and a motor 7 for ratating the shaft. The shaft 4 is provided at its lower end with a barrel or cylinder 8 the lowermost edge of which is preferably formed into sow blade shape to assist in penetrating the soil formation. Agitating or mixing blades 9 are attached onto the internal and/or external surface of the barrel 8. The barrel 8 is preferably 1500 – 2500 mm in its diameter for the purpose of increasing efficiency of works. The barrel 8 is exchangeable together with the lower most end section of the shaft 4 so as to form any desired thickened tubular wall, depending upon the character of the soil being worked upon. In this connection, the length, the width, the number and the angle of the blade are determined taking resistance of the soil into consideration. The agitating device is also equipped with a chemical hardener suplying system including flexible hoses 10, swivel joints 11, conduits and injection nozzle 12. The hoses are used to transport the chemical hardener slurry from a suitable chemical plant (not shown) to the swivel joints mounted on the shafts 4. From the swivel joints are extended the conduits within the shafts, to the nozzles. The nozzle 12 for discharging solidifying agent or chemical hardener into the soil are provided on the barrel adjacent the blades 9. FIG. 6 shows a device with twin shafts having similar agitating blades 9, circular range of agitation of which are arranged to overlap each other. Number and arrangement of the shafts of the agitating device C are not limited to FIGS. 5 and 6. The device C with a lot of the shafts 4 may be employed for performance of the invention.

The device C is operated by rotating the shaft 4 through driving device 5, sinking it into the soft soil simultaneously with agitating or stirring it, discharging stabilizing agent such as bentonite through the nozzles 12 and mixing with the soft soil or loose soil by action of the blades 9. This operation is continuously proceeded to the desired depth to be worked upon.

When the shaft 4 reaches desired depth or hard soil stratum, solidifying agent or chemical hardener is now discharged through the nozzle 12 instead of the stabilizing agent. Then, the shaft 4 is gradually withdrawn while continuing to rotate the shaft and mix the hardener with the previously stabilized soft soil to the region of the surface. By repeating the foregoing operation at suitable horizontally spaced locations, a continuous solidified foundation is quickly and efficiently formed over any desired area. The sinking operation mentioned may be worked without discharging stabilizing agent.

When using the agitating device C shown in FIG. 5, the piles 3 are formed and solidified in tubular shape with annulus in section as shown in FIG. 2A. The diameter of pile is preferably 2500 – 3500 mm and a mass of the soil and sand is effeciently enclosed with the annulus wall in single operation. When using the device C shown in FIG. 6, the piles 3 are solidified in connected-tubular shape with connected annulus in section as shown in FIG. 2B. Because of further development of the successive or multiple tubular piles, considerably large enclosure, shown in FIG. 4, may be formed according to the demand of the work.

The performance of the invention mentioned will bring about secondary but very favorable by-product. That is, during mixing operation of chemical hardener with soft soil, a bulk of the soil is expanded in fluid state and overflowed above the surface of the soil formation from the spot of agitation. The overflowed soil extends in all directions over treated area and is solidified to form a mat above the pile foundation. Then, the untreated soils are confined with the overflowed soil and the wall of piles, as shown in FIG. 1. This action of the overflowed soil results in connecting upper end of the tubular piles to each other so that the mat serves to uniformly transfer the weight of the structures to the earth and the foundation.

What is claimed is:

1. A method of constructing a tubular pile foundation in soft soil formations comprising agitating the soft soil to form an agitated region like a tube with single annular section to the depth reaching a bedrock or to the substantial depth enough to provide required bearing capacity with the soft soil formations, injecting chemical hardener slurry into the soft soil during said agitating, simultaneously mixing the chemical hardener slurry with the soft soil to give soil mixture to be solidified, repeating foregoing steps before the last agitated tubular region is completely solidified so that a new agitated tubular region is adjacent to or partly overlapped said last agitated tubular region, and solidifying in situ a wall of linked tubular piles formed through said repeating, wherein the soft soil formation is provided with bearing capacity by constructing a structural wall foundation of the linked piles therein.

2. A method for constructing a tubular pile foundation in soft soil formations, agitating the soft soil to form an agitated region like a conjugated tubes with at least one pair of annular section at a time to the depth reaching a bedrock or to the substantial depth enough to provide bearing capacity with the soft soil formations, injecting chemical hardener slurry into the soft soil during said agitating, simultaneously mixing the chemical hardener slurry with the soft soil to give soil mixture to be solidified, repeating the foregoing steps before the last agitated conjugated region is completely solidified so that a new agitated conjugated tubular region is adjacent to or overlapped with said last agitated conjugated tubular region, solidifying in situ a wall of linked tubular piles formed through said repeating, and wherein the soft soil formation is provided with bearing capacity by constructing a structural wall foundation of the linked tubular piles therein.

3. a method claimed in claim 1, wherin a part of said soil mixture is overflowed during said mixing over a surface of the soft soil formations as to form a mat covering the pile foundation.

4. A method claimed in claim 2, wherein a part of said soil mixture is overflowed during said mixing over a surface of the soft soil formations as to form a mat covering the pile foundation.

5. The method as claimed in claim 1, wherein said steps of agitating and mixing include the step of rotationally driving a drive shaft and an agitating barrel having a plurality of blades thereon to agitate a tube-shaped region.

6. The method as claimed in claim 2, wherein said steps of agitating and mixing include the step of rotationally driving at least one drive shaft and at least one agitating barrel, each barrel having a plurality of blades thereon to agitate at least one tube-shaped region.

* * * * *